US007797831B2

(12) United States Patent
Kubo

(10) Patent No.: US 7,797,831 B2
(45) Date of Patent: Sep. 21, 2010

(54) METHOD FOR MANUFACTURING RECORDING APPARATUS

(75) Inventor: Tomoyuki Kubo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 631 days.

(21) Appl. No.: 11/821,651

(22) Filed: Jun. 25, 2007

(65) Prior Publication Data

US 2008/0000073 A1 Jan. 3, 2008

(30) Foreign Application Priority Data

Jun. 27, 2006 (JP) ..... 2006-177097

(51) Int. Cl.
*B21D 53/00* (2006.01)

(52) U.S. Cl. ..... 29/890.1; 29/592.1; 29/25.35; 29/832; 29/846; 29/860; 228/111.5

(58) Field of Classification Search ..... 29/25.35, 29/890.1, 832, 842, 846, 840, 854, 860
See application file for complete search history.

(56) References Cited

U.S. PATENT DOCUMENTS 6,604,817 B2 8/2003 Isono et al.
7,536,762 B2 * 5/2009 Imai et al. ..... 29/25.35
2005/0253488 A1 11/2005 Ito
2007/0272433 A1 * 11/2007 Gorrell et al. ..... 174/250

FOREIGN PATENT DOCUMENTS

| | | |
|---|---|---|
| JP | 2001-246744 | 9/2001 |
| JP | 2004-098465 | 4/2004 |
| JP | 2005-313428 | 11/2005 |
| JP | 2005-322850 | 11/2005 |
| JP | 2006-176399 | 6/2006 |
| JP | 2006-178131 | 6/2006 |
| JP | 2006-190254 | 7/2006 |

* cited by examiner

*Primary Examiner*—Derris H Banks
*Assistant Examiner*—Azm Parvez
(74) *Attorney, Agent, or Firm*—Eugene LeDonne; Joseph W. Treloar; Frommer Lawrence & Haug LLP

(57) ABSTRACT

There is provided a method for manufacturing a recording apparatus which includes an actuator, a flexible flat cable connected to the actuator, and a circuit element mounted on the flexible flat cable, the method including: applying a conductive material for connection to the actuator and the circuit element, on terminal electrodes formed on one surface of the flexible flat cable; and forming bumps for joining the actuator to the terminal electrodes while joining the circuit element to the terminal electrodes. This makes it possible to mount the circuit element for preventing a malfunction of the recording apparatus, without any great increase in the number of manufacturing processes of the recording apparatus.

11 Claims, 9 Drawing Sheets

METHOD FOR MANUFACTURING RECORDING APPARATUS

CROSS REFERENCE TO RELATED APPLICATION

The present application claims priority from Japanese Patent Applications No. 2006-177097, filed on Jun. 27, 2006, the disclosure of which are incorporated herein by reference in their entirety.

BACKGROUND OF THE INVENTION

1. Field of the Invention

The present invention relates to a method for manufacturing a recording apparatus in which a flexible flat cable is connected to a recording head, more particularly, to a method for manufacturing a recording apparatus in which circuit elements are mounted on the flexible flat cable.

2. Description of the Related Art

Japanese Patent Application Laid-open No. 2004-98465 (FIGS. 6 and 7) describes a recording apparatus which includes a body-side board and a head board disposed in a casing of the apparatus, a flexible flat cable connecting the body-side board and the head board, a recording head, a carriage moving for scanning with the recording head mounted thereon, another flexible flat cable connecting the recording head and the head board, and a driver IC outputting a drive pulse signal to these flexible flat cable.

When recording elements mounted on a recording head are arranged densely, a pattern wiring formed on a flexible flat cable connected to the recording head also has to be fine, which increases resistance of the pattern wiring. Therefore, the driving IC chip is mounted on the flexible flat cable so that the driving IC chip is disposed as close to the recording head as possible.

Further, there is concern that voltage may decrease when the plural recording elements are driven almost simultaneously, and therefore, a capacitor is disposed on the head board provided on the carriage to compensate for the lack of the voltage. However, when control becomes diversified, for example, when the kind of drive pulse signals for driving the recording head increases due to an increase in gradation levels, a pattern wiring connecting the driving IC chip and the head-side circuit board is also made finer, and a resistance component and an inductance component of the pattern wiring sometimes cause a malfunction of the driving IC chip.

Further, in a case where a piezoelectric actuator is used as an actuator of the recording head, polarization processing of a piezoelectric material is sometimes performed in a state where the flexible flat cable is connected to the piezoelectric actuator. When the piezoelectric material is heated and thereafter cooled (its temperature is returned to room temperature) during this polarization processing, charges are generated in the piezoelectric material and these charges sometimes break the circuit.

To prevent these malfunction and/or breakage of the circuit, there is a demand to mount circuit elements (protection circuits) near the actuator or the driving IC chip.

To electrically connect the flexible flat cable and the actuator, terminal electrodes are exposed from a surface, of the flexible flat cable, facing the actuator and bumps are formed on the terminal electrodes. When the formation of the bumps on the terminal electrodes and the mounting of the aforesaid circuit elements on the flexible flat cable are performed in independent manufacturing processes, the number of processes increases, which has posed a problem of cost increase.

SUMMARY OF THE INVENTION

The present invention solves the above-described problems, and it is an object of the present invention to realize a method for manufacturing a recording apparatus, the method capable of preventing a malfunction and capable of mounting a circuit element for malfunction prevention on a flexible flat cable without any great increase in the number of manufacturing processes.

According to an aspect of the present invention, there is provided a method for manufacturing a recording apparatus which includes: a recording head including a plurality of recording elements and an actuator having a plurality of driving portions selectively driving the recording elements; a flexible flat cable having a plurality of conductive wires electrically connected to the driving portions of the actuator at one end of the conductive wires; and a circuit element mounted on the flexible flat cable, the method comprising:

forming a plurality of first terminal electrodes, which are to be connected to the driving portions, by exposing one ends of the conductive wires in one surface of the flexible flat cable, and a plurality of second terminal electrodes, which are to be connected to the circuit element, by exposing a part of each of the conductive wires in the one surface of the flexible flat cable;

applying a conductive material on the first terminal electrodes and the second terminal electrodes;

arranging the circuit element on the second terminal electrodes;

softening the conductive material by heating;

forming bumps on the first terminal electrodes by curing the softened conductive material while joining the circuit element to the second terminal electrodes by curing the softened conductive material; and joining the first terminal electrodes to the driving portions of the actuator by positioning the first terminal electrodes to the driving portions and by heating and softening the bumps.

According to the aspect of the present invention, even in a case where resistance component of the flexible flat cable increases because a pattern wiring of the flexible flat cable becomes finer, the circuit element mounted on the flexible flat cable as required can ensure the operation of the recording elements. Further, in the flexible flat cable, the surface on which the circuit element is mounted is the same as the surface on which the bumps for joining the flexible flat cable to the actuator are formed, and therefore, the conductive material used for mounting the circuit element and the conductive material used for joining the flexible flat cable to the actuator can be applied on the flexible flat cable in the same process. Further, the mounting of the circuit element and the formation of the bumps on the flexible flat cable can be performed in the same process, which enables efficient manufacturing processes of the recording apparatus.

In the method for manufacturing the recording apparatus of the present invention, the conductive material may be solder paste, the solder paste may be applied on the first and second terminal electrodes by printing, and subsequently the circuit element may be arranged on the second terminal electrodes.

In this case, since, the solder paste is printed on each of the terminal electrodes as the conductive material, the solder paste for joining the flexible flat cable to the circuit element can be formed on the flexible flat cable simultaneously when the solder paste for joining the flexible flat cable to the actuator is formed on the flexible flat cable. Therefore, an independent process for mounting the circuit element is not necessary.

In the method for manufacturing the recording apparatus of the present invention: the flexible flat cable may include an insulating base film and a cover film which are disposed to sandwich the conductive wires;

the first and second terminal electrodes may be exposed, upon forming the first and second terminal electrodes, by forming openings at portions, of the cover film, corresponding to the first and second terminal electrodes of the conductive wires; and the conductive material may be applied, upon applying the conductive material, on the first and second terminal electrodes exposed from the openings formed in the cover film.

In this case, regarding the flexible flat cable having the insulating base film, the conductive wires, and the cover film, the openings are formed at portions, of the cover film, corresponding to the terminal electrodes of the conductive wires and the conductive material is applied on the terminal electrodes exposed from the openings, and therefore, it is possible to easily join the flexible flat cable to the circuit element or the actuator.

In the method for manufacturing the recording apparatus of the present invention, the recording apparatus may further include: a driving IC chip mounted on the flexible flat cable to supply a drive voltage signal selectively to the driving portions of the actuator; and a power source; and the method may further include connecting the circuit element to the conductive wires between the driving IC chip and the power source to supply current to the driving IC chip and the driving portions.

In this case, in the flexible flat cable on which the driving IC chip is mounted, the circuit element mounted on the flexible flat cable can prevent the malfunction of the driving IC chip and the recording elements.

The method for manufacturing the recording apparatus of the present invention may further include: forming a third terminal electrode, which is to be connected to the driving IC chip, by exposing a part of each of the conductive wires in a surface of the flexible flat cable opposite the one surface thereof; and joining the driving IC chip to the third terminal electrode.

In this case, in a process different from the process of mounting the circuit element, the driving IC chip can be joined so as to correspond to the conductive wires of a large number of the driving portions.

The method for manufacturing the recording apparatus of the present invention may further include:

forming a third terminal electrode, which is to be connected to the driving IC chip, by exposing a part of each of the conductive wires in the one surface of the flexible flat cable;

applying the conductive material on the third terminal electrode;

arranging the driving IC chip on the third terminal electrode; and joining the driving IC chip to the third terminal electrode by curing the softened conductive material.

In this case, the mounting of the circuit element and the mounting of the driving IC chip can be performed in the same process.

In the method for manufacturing the recording apparatus of the present invention, the actuator may be a piezoelectric actuator, and the method may further include: performing polarization processing to the piezoelectric actuator by heating and subsequently cooling the piezoelectric actuator. The circuit element may discharges charges generated when the piezoelectric actuator is heated and cooled during the polarization processing.

In this case, in a case where the actuator is a piezoelectric actuator, since the charges generated when the piezoelectric actuator is heated and cooled during the polarization processing can be discharged by the circuit element, the circuit can be prevented from breaking during the polarization processing.

In the method for manufacturing the recording apparatus of the present invention, the conductive material may be heated by being irradiated an infrared light or a laser, upon softening the conductive material. In this case, since it is possible to heat the conductive material without any contact of a heat source with the conductive material, the degree of freedom in arranging the flexible flat cable and an infrared light source/a laser source can be increased in the softening process, which can enable uniform heating over a desired range of the flexible flat cable.

In the method for manufacturing the recording apparatus of the present invention, the recording apparatus may include a heat sink, and the method may further include contacting the driving IC chip joined to the third terminal electrode with the heat sink tightly. In this case, heat generation of the driving IC chip can be reduced owing to the close contact of the driving IC chip with the heat sink.

In the method for manufacturing the recording apparatus of the present invention, the circuit element may include a resistor and a capacitor. In this case, in the actuator, since excessive charges can be discharged through the resistor and charges for compensating charges deficiency can be supplied via the capacitor, a malfunction of the actuator can be prevented.

In the method for manufacturing the recording apparatus of the present invention, the flexible flat cable may have a first flexible flat cable of which one end is connected to the driving portions of the actuator and a second flexible flat cable connected to the other end of the first flexible flat cable, and the driving portions, the circuit element, and the driving IC chip may be connected to the first flexible flat cable. In this case, the degree of wiring freedom can be increased since the flexible flat cable has the two cables. Moreover, since the driving portions, the circuit element, and the driving IC chip are connected to the first flexible flat cable connected to the driving portions of the actuator, distance from the circuit element to the driving portion and/or the driving IC chip can be shortened. Therefore, the malfunction of the apparatus can be prevented.

DETAILED DESCRIPTION OF THE PREFERRED EMBODIMENTS

Figure 1:
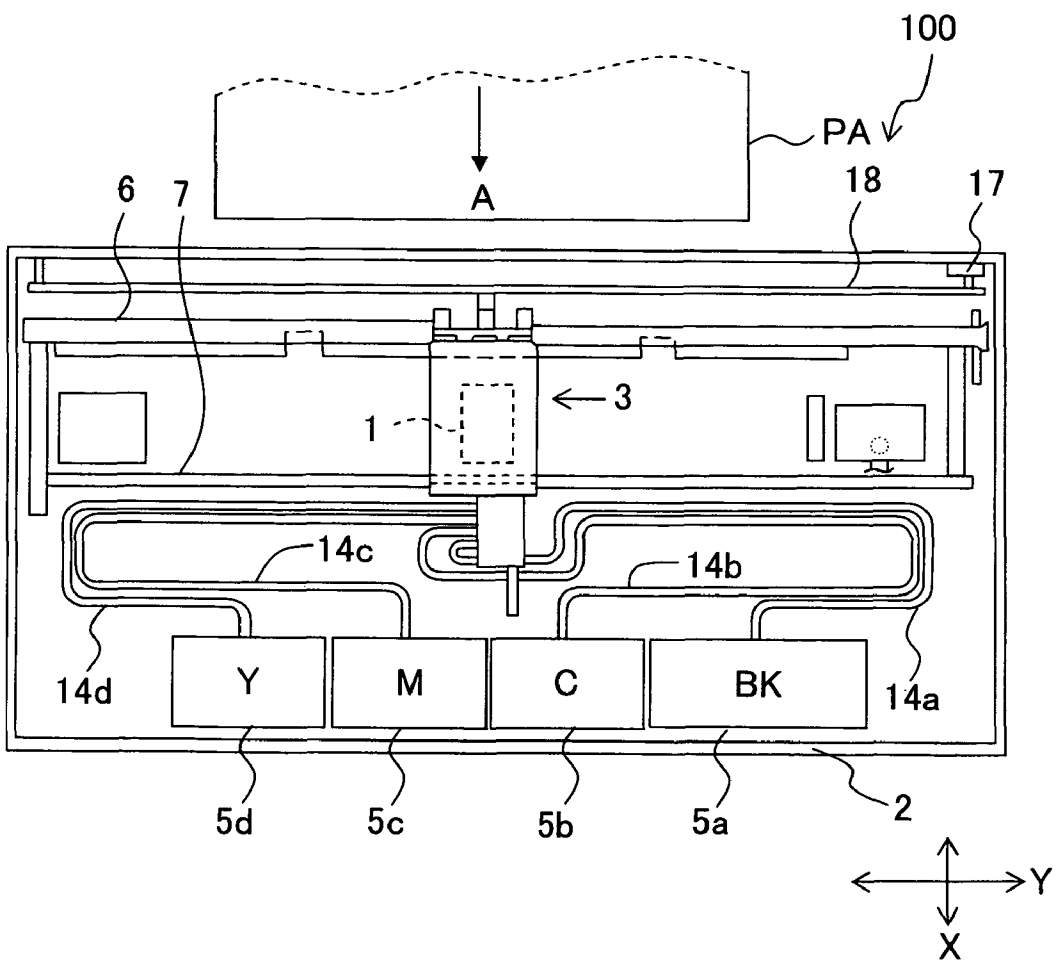
FIG. 1 is a plan view of an ink-jet recording apparatus according to an embodiment.

Hereinafter, a first embodiment of the present invention will be explained. FIG. 1 shows an ink-jet recording apparatus 100 according to the recording apparatus of the present invention. The ink-jet recording apparatus 100 of this embodiment is applicable, for example, not only to a printer apparatus having only a printer function but also to a multi function device (MFD) having a copy function, a scanner function, a facsimile function, and so on in addition to the printer function. The ink-jet recording apparatus 100 includes a body frame 2; a recording head 1 which performs recording by jetting ink onto a paper PA as a recording medium; a carriage 3 disposed inside the body frame 2, having the recording head 1 mounted thereon, and running along a primary scanning direction (Y direction); two guide shafts (a rear guide shaft 6 and a front guide shaft 7) provided along the primary scanning direction in the body frame to be parallel to each other; a carriage drive motor 17 disposed in a right rear portion of the body frame 2; and a timing belt 18 which is an endless belt.

The carriage 3 is slidably attached on the two guide shafts (the rear guide shaft 6 and the front guide shaft 7), and is moved back and forth in the primary scanning direction (Y direction) by the carriage drive motor 17 and the timing belt 18. The ink-jet recording apparatus 100 further includes ink supply sources (ink tanks) 5*a*, 5*b*, 5*c* and 5*d* arranged in the body frame 2, and ink supply pipes 14 (14*a*, 14*b*, 14*c* and 14*d*) connecting the ink supply sources 5*a* to 5*d* and the recording head 1 to each other, and inks are supplied to the recording head 1 via the ink supply pipes 14 (14*a* to 14*d*) from the ink supply sources (5*a* to 5*d*). In this embodiment, the ink supply sources 5*a* to 5*d* contain a black ink (Bk), a cyan ink (C), a magenta ink (M), and a yellow ink (Y) respectively.

The paper PA is fed under a lower surface of the recording head 1 horizontally by a generally-known paper feed mechanism (not shown) in a direction of the arrow A in FIG. 1, that is, along a secondary scanning direction (X direction) perpendicular to the primary scanning direction (Y direction) The ink is jetted downward for recording to the paper PA from nozzles (not shown) opening in the lower surface of the recording head 1 which moves in the primary scanning direction (Y direction). In the present application, in the recording head 1, the surface on the side where the nozzles are opened is defined as a front surface or a lower surface, and a surface opposite this surface is defined as a rear surface or an upper surface.

Figure 2:
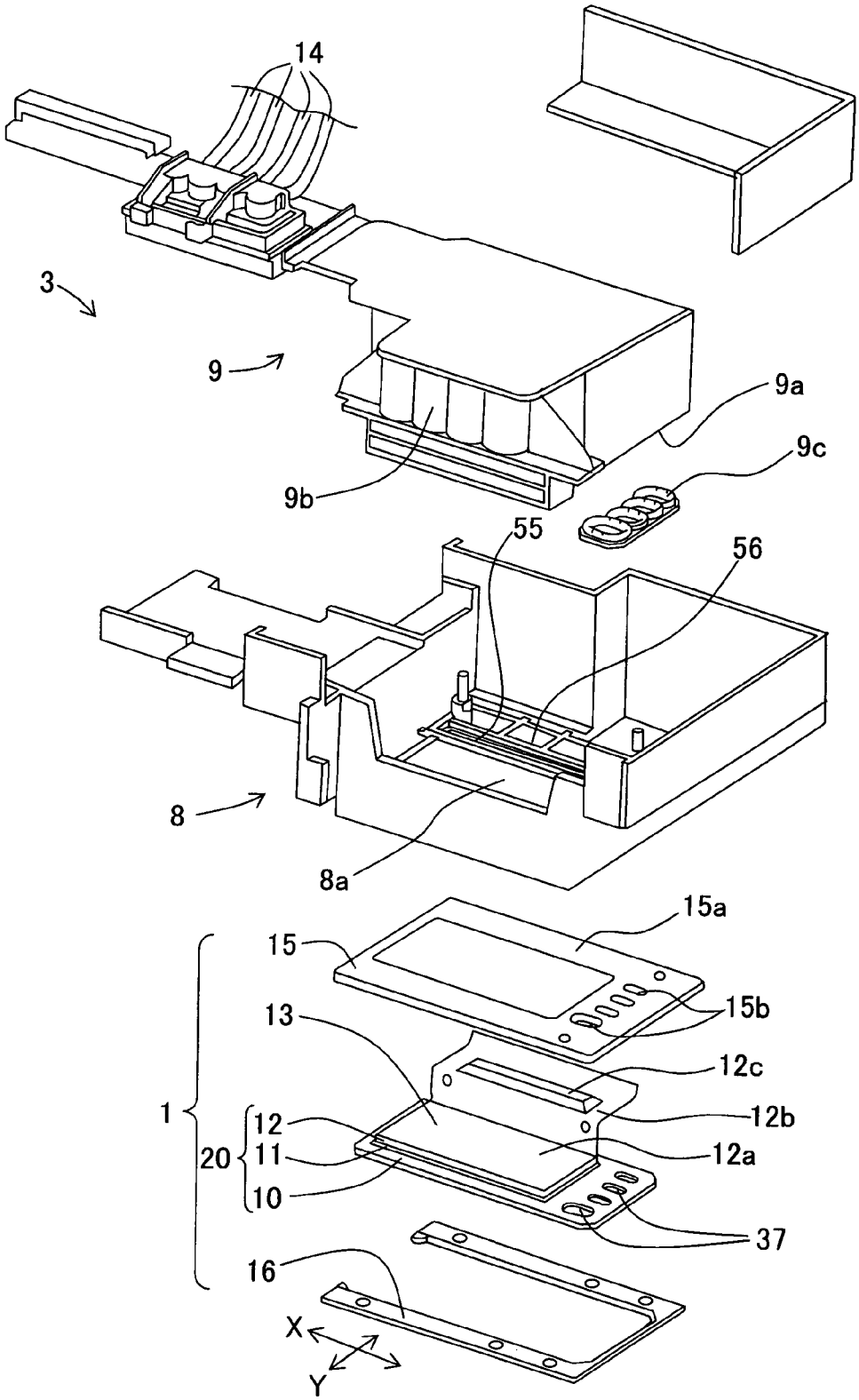
FIG. 2 is an exploded perspective view of a carriage.
Figure 3:
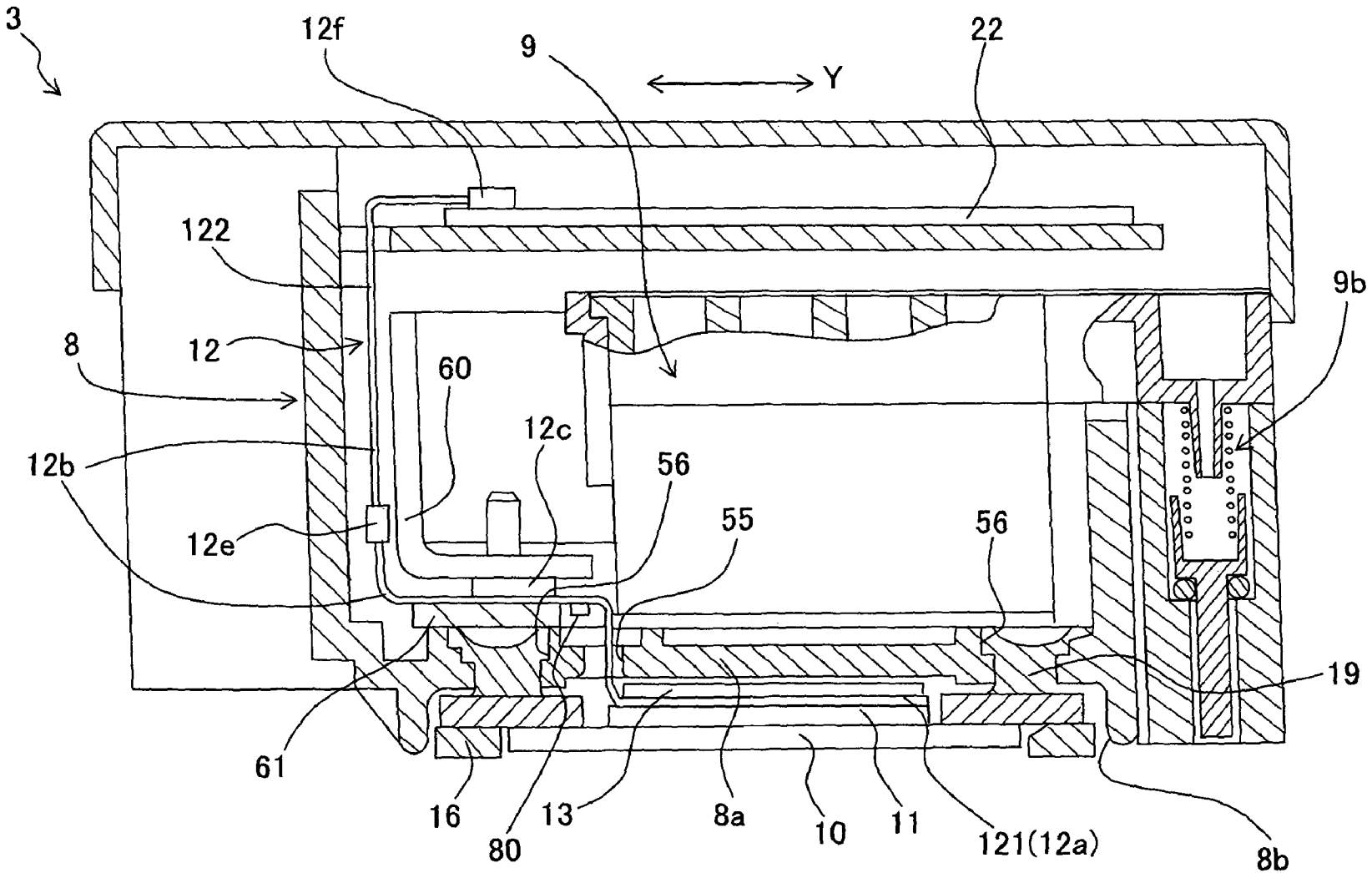
FIG. 3 is a cross-sectional view of the carriage taken along a Y direction.
Figure 4:
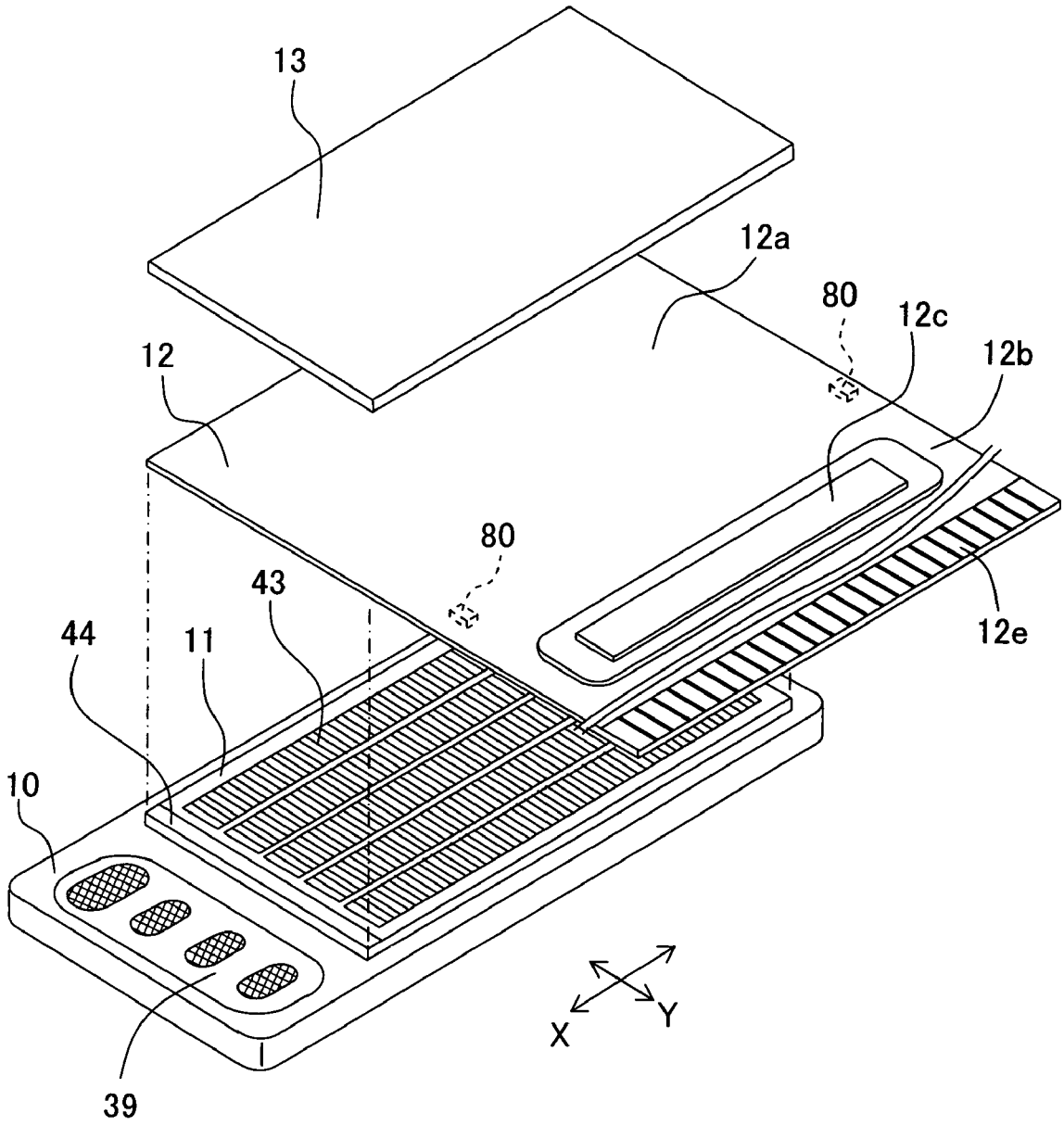
FIG. 4 is an exploded perspective of a recording head.

As shown in FIG. 2, the carriage 3 includes a head holder 8 in a substantially box shape. The head holder 8 includes a bottom plate (base plate) 8*a* and a recess 8*b* which is formed in a lower surface of the bottom plate 8 with its opening side facing downward. As shown in FIG. 3, the recording head 1 is fixed to the head holder 8 so as to be substantially parallel to the bottom plate 8*a*, with the nozzles exposed downwardly.

A head-side circuit board 22, on which electric circuits are formed, is provided on a rear side of the head holder 8, the electric circuits being electrically connected to the recording head 1 and a body-side board (not shown) disposed in the body frame 2. The head-side circuit board 22 is disposed at a position, of the head holder 8, overlapping with the recording head 1 when seen from the rear surface side of the head holder 8.

A damper device 9 storing the inks to be supplied to the recording head 1 is mounted at a position which is between the recording head 1 and the head-side circuit board 22 and is on an upper surface side of the bottom plate 8*a* of the head holder 8. The inside of the damper device 9 is divided into a plurality of ink chambers, and different color inks are stored in the respective ink chambers. The damper device 9 also includes a discharge valve mechanism 9*b* which removes bubbles staying in the inks in the ink chambers.

An opening (not shown) is penetratingly formed in the bottom plate 8*a* of the head holder 8. As shown in FIG. 2, in the opening, ink outlet ports 9*a* of the damper device 9 and ink inlet ports 37 of the recording head 1 are connected to each other via connection holes 15*b* of a reinforcing frame 15 (to be described later) and elastic seal members 9*c*. Each of the color inks is independently supplied from the damper device 9 to the recording head 1.

As shown in FIGS. 2 and 3, a slit hole 55 through which a flexible portion 12*b* of a flexible flat cable 12 (to be described later) is inserted from a front surface side to a rear surface side, and a through hole 56 from which an adhesive 19 for fixing the recording head 1 to the front surface side of the bottom plate 8*a* is poured are formed in the bottom plate 8*a* of the head holder 8.

The recording head 1 includes: a head unit 20; a heat transfer plate 13 and the reinforcing frame 15 which are provided on a rear surface side of the head unit 20; and a front frame 16 surrounding an outer periphery of the head unit 20, the head unit 20 having: a stacked structure of a cavity unit 10 in whose lower surface the plural nozzles are opened and in which ink channels are formed; an actuator 11 which applies a jetting pressure selectively to the inks in the cavity unit 10; and the flexible flat cable 12 which outputs a driving signal to the actuator 11.

As in generally known cavity units described in Japanese Patent Application Laid-open Nos. 2001-246744, 2005-313428, and so on, the inks supplied individually to the ink inlet ports 37 exposed in an X direction end side of an upper surface of the cavity unit 10 are distributed to a large number of pressure chambers through manifold chambers respectively in the cavity unit 10. Then, driving portions of the actuator 11 are driven to apply the jetting pressure selectively to the pressure chambers, and consequently, the inks are jetted from the nozzles communicating with the pressure chambers. In this application, the manifold chambers and the pressure chambers are not shown.

Similarly to generally known actuators disclosed in Japanese Patent Application Laid-open No. 2005-322850 and soon, the actuator 11 has a plurality of stacked ceramics layers and inner electrodes (not shown) sandwiched between the ceramics layers, and the driving portions (active portions) are formed in regions, of the ceramics layers, sandwiched by the inner electrodes. The inner electrodes include a plurality of electrodes corresponding to the respective pressure chambers (individual inner electrodes) and an electrode common to the pressure chambers (common inner electrode). Outer individual electrodes 43 electrically connected to the individual inner electrodes via through holes and an outer common electrode 44 connected to the common inner electrode are formed on the upper surface of the actuator 11. The active portions are displaced by a drive pulse signal applied to the outer individual electrodes 43 to apply the jetting pressure selectively to desired pressure chambers among the pressure chambers. The outer individual electrodes 43 are electrically connected individually to first terminal electrodes 89*a* (see FIG. 6) formed on the flexible flat cable 12, and the outer common electrode 44 is electrically connected to a common potential line COM formed in the flexible flat cable 12.

The reinforcing frame 15, which is a member for reinforcing the cavity unit 10, is made of a material (for example, a metal plate made of SUS or the like) higher in rigidity than the cavity unit 10. The outer shape of the reinforcing frame 15 is slightly larger than that of the cavity unit 10. The reinforcing frame 15 is stacked along the rear surface of the cavity unit 10 so as to surround the actuator 11 and is fixed onto the cavity unit 10. Therefore, the deformation and distortion of the thin cavity unit 10 are prevented. The connection holes 15*b* corresponding to the ink inlet ports 37 of the cavity unit 10 are penetratingly formed at an end, in X-direction, of a frame portion 15*a* of the reinforcing frame 15.

Further, the heat transfer plate 13 is stacked at a position corresponding to the actuator 11 on a rear surface of the flexible flat cable 12. The heat transfer plate 13 is a substantially rectangular plate large enough to cover substantially the whole surface of the actuator 11. The heat transfer plate 13 is made of a material higher in heat conductivity than the actuator 11 and the flexible flat cable 12 and higher in rigidity than the flexible flat cable 12, for example, a metal plate of aluminum, copper, SUS, or the like. The heat transfer plate 13 is in close contact with the actuator 11 via the flexible flat cable 12, thereby exhibiting effects of dispersing heat locally generated from the actuator 11 to reduce a variation in temperature distribution and releasing this heat. The heat transfer plate 13 also exhibits an effect of increasing rigidity of the head unit 20 as a whole. The heat transfer plate 13 is not always required and can be sometimes omitted.

As shown in FIGS. 2 and 3, the front frame 16, which is a U-shaped plate, is disposed so as to surround the cavity unit 10, and is fixed to a front surface of the reinforcing frame 15. The front frame 16 eliminates level difference between the nozzle surface of the cavity unit 10 and an area around the head holder 8, thereby preventing a wiper or the like from getting caught in the nozzle surface when the nozzle surface is cleaned with the wiper or the like.

The flexible flat cable 12 includes: a flat portion 12*a* which has a belt-shaped form, which is provided in one end thereof and which is joined to the actuator 11; and a flexible portion 12*b* which is provided in the other end side thereof and connected to the flat portion 12*a*. On a rear surface (lower surface) of the flat portion 12*a*, the first terminal electrodes 89*a* electrically connected to the outer individual electrodes 43 and the outer common electrode 44 are formed, and bumps 92 are formed on the first terminal electrodes 89*a* respectively. Further, on a front surface (upper surface) of the flexible portion 12*b*, a driving IC chip 12*c* driving the actuator 11 is mounted, and on a rear surface (lower surface) of the flexible portion 12*b*, circuit elements 80 other than the driving IC chip 12*c*, such as a capacitor and a resistor, are mounted. An end portion, of the flexible portion 12*b*, opposite the flat portion 12*a* is connected to the head-side circuit board 22 via a connection terminal 12*f*.

Figure 5:
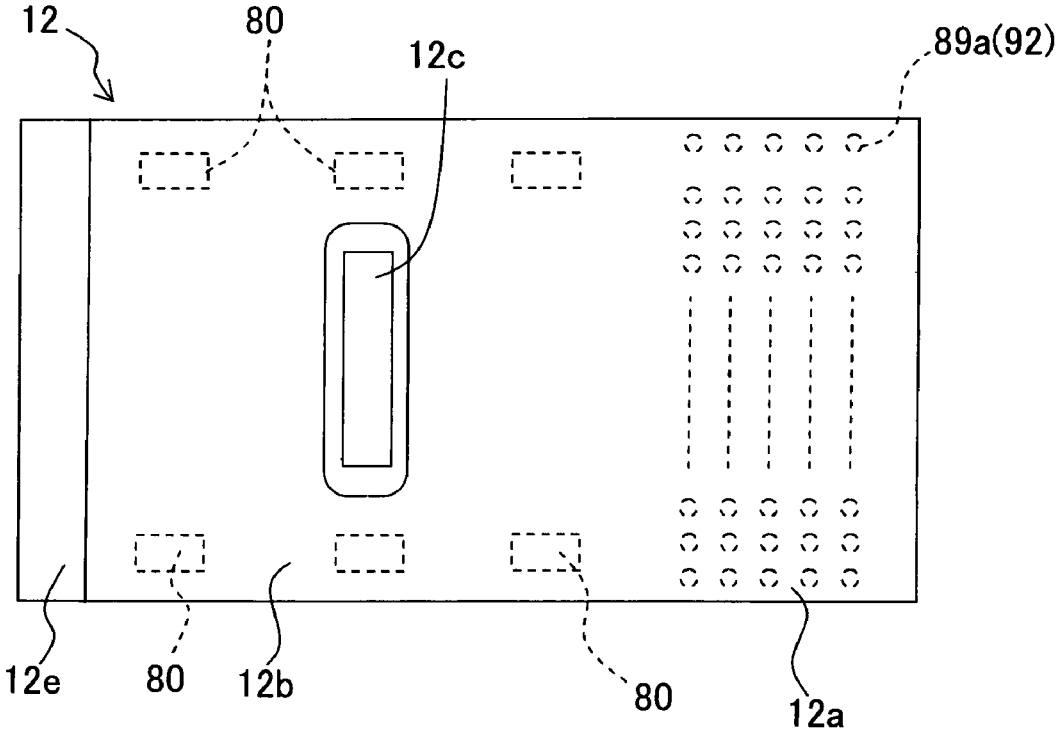
FIG. 5 is an expanded view of a flexible flat cable.

The flexible flat cable 12 can be formed as one continuous cable, but as shown in FIGS. 3 and 5, in this embodiment, the flexible flat cable 12 has a first cable 121 and a second cable 122 which are mutually coupled in its longitudinal direction via a connection terminal 12*e*. The first cable 121 has the first terminal electrodes 89*a* electrically connected to the actuator 11, the common potential line COM, and a large number of conductive wires connected to the driving IC chip 12*c*, and these lines and terminals are printed on an insulating base film. The second cable 122 is a general-purpose cable having conductive wires arranged in parallel. The first cable 121 has the flat portion 12*a* stacked on the actuator 11 and the flexible portion 12*b* extending from the flat portion 12*a* and connected to the second cable 122. The driving IC chip 12*c* and the circuit elements 80 (to be described later) are mounted on the flexible portion 12*b*.

As shown in FIG. 2, the slit hole 55 which is long in the X direction is penetratingly formed in the bottom plate 8*a* of the head holder 8, and the flexible portion 12*b* of the flexible flat cable 12 is wired from the front surface side to the rear surface side of the head holder 8 through the slit 55. A heat sink 60 is provided so as to be adjacent to the slit hole 55 on the upper surface side of the bottom plate 8*a* of the head holder 8. The heat sink 60 is a highly heat conductive metal member which is bent so as to have an L-shaped side section, and has a bottom surface (contact surface) 60*a* parallel to the bottom plate 8*a* and a side surface (guide surface) 60*b* extending in parallel to a sidewall, of the head holder 8, opposed to the guide surface 60*b* in the Y direction.

The flexible portion 12*b* of the flexible flat cable 12 passes between the bottom surface 60*a* of the heat sink 60 and the bottom plate 8*a*. The driving IC chip 12*c* is in contact with the contact surface 60*a* of the heat sink 60 in a heat conductive manner by being pressed by a sponge-formed (or rubber-formed) elastic member 61. Therefore, the heat generated from the driving IC chip 12*c* is released by the heat sink 60. To surely release the heat generated from the driving IC chip 12*c*, the contact surface 60*a* has a larger area than an area of the upper surface of the driving IC chip 12*c* (surface parallel to the flexible flat cable 12).

As shown in FIG. 2, the first and second cables 121, 122 included in the flexible flat cable 12 are connected to each other at a position close to a lower end of the guide surface 60*b* of the heat sink 60, and the flexible flat cable 12 is guided to the head-side circuit board 22 positioned on the rear surface side of the head holder 8.

Figure 6:
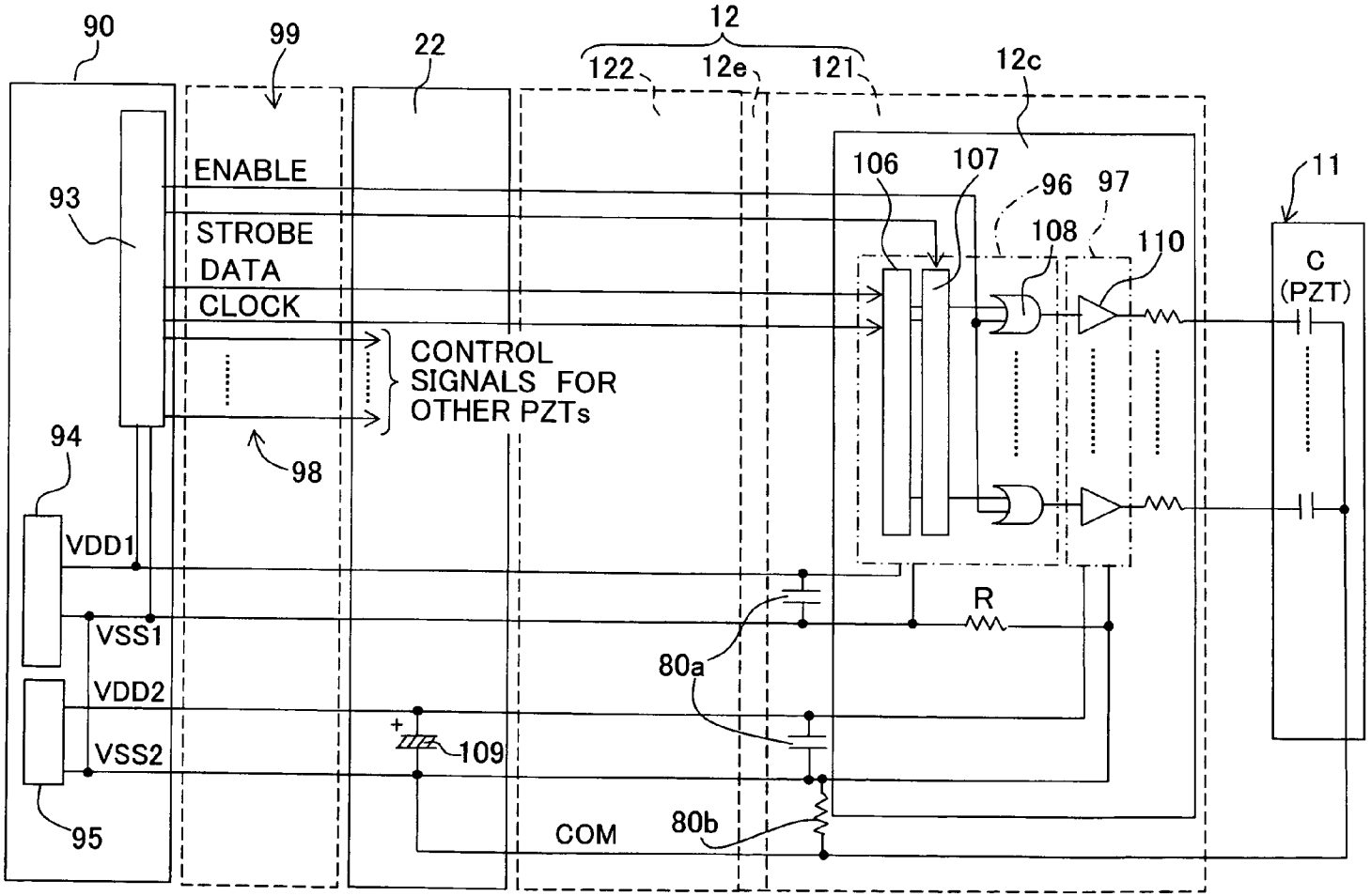
FIG. 6 is an electric circuit diagram of the ink-jet recording apparatus of this embodiment.

FIG. 6 shows an example of an electric circuit applied to this embodiment. In the recording apparatus 100, the body-side board 90, the head-side circuit board 22, the driving IC chip 12*c*, and the actuator 11 are mutually connected. A control circuit 93, a control signal power source 94, and a drive pulse power source 95 are mounted on the body-side board 90. The driving IC chip 12*c* includes a signal converter circuit 96 and a drive voltage signal generator circuit 97.

The control circuit 93 outputs control signals such as enable, data, clock, and strobe signals to the signal converter circuit 96 based on predetermined recording information, and is connected to the signal converter circuit 96 via control signal lines 98. The control signal power source 94 supplies voltage (for example, 5 volts) to the signal converter circuit 96, and is connected to the signal converter circuit 96 via a driving line VDD1 for drive voltage application and via a grounding line VSS1. The drive pulse power source 95 supplies voltage (for example, 20 volts) to the drive voltage signal generator circuit 97, and is connected to the drive voltage signal generator circuit 97 via a driving line VDD2 for drive voltage application and via a grounding line VSS2.

Concretely, the body-side board 90 and the head-side circuit board 22 are connected to each other via a flexible flat cable 99 on which the driving lines VDD1 and VDD2, the grounding lines VSS1 and VSS2, and the control signal lines 98 are arranged in a width direction of the flexible flat cable 99. The driving IC chip 12*c* mounted on the first cable 121 and the head-side circuit board 22 are connected to each other via the second cable 122 including the aforesaid lines and the common potential line COM connected to the outer common electrode 44 of the actuator 11.

On the head-side circuit board 22, an electrolytic capacitor 109 is bypass-connected to the driving line VDD2 and the grounding line VSS2 to store charges which are to be supplied to the drive voltage signal generator circuit 97, thereby preventing voltage drop of the drive pulse power source 95 when large current flows instantaneously to the drive voltage signal generator circuit 97. Further, the ground line VSS2 and the common potential line COM connected to the outer common electrode 44 of the actuator 11 are mutually connected. On the first cable 121 or in the driving IC chip 12*c*, the ground line VSS2 and the ground line VSS1 are mutually connected via a resistor R, and therefore, the drive voltage signal generator circuit 97 and the signal converter circuit 96 are kept at the same potential.

The signal converter circuit 96 converts each of the control signals sent from the control circuit 93 into a control signal corresponding to each of the nozzles, and includes shift registers 106, D flip-flops (delay flip flops) 107, and gate circuits 108. The number of these shift registers 106 etc. corresponds to the number of the nozzles. Regarding the control signals sent from the control circuit 93 via the control signal lines 98, the data and clock signal are supplied to the shift registers 106, the strobe signal is supplied to the D flip-flops 107, and the enable signal is supplied to the gate circuits 108. The data are serially transferred from the control circuit 93 to be converted to parallel signals corresponding to a nozzle row by the shift registers 106, and the parallel signals are outputted from the D flip-flops 107 based on the strobe signal. Then, the enable signal (driving waveform signal) corresponding to the data is outputted from the gate circuits 108.

The drive voltage signal generator circuit 97 converts the enable signal (driving waveform signal) outputted from each of the gate circuits 108 to a voltage signal for driving the actuator 11, based on the voltage supplied from the drive pulse power source 95 to generate and output a drive pulse. The drive voltage signal generator circuit 97 has 150 pieces of drivers 110 corresponding to the number of the nozzles.

According to the recording apparatus as structured above, the voltage, to be supplied to the signal converter circuit 96 from the control signal power source 94, is supplied to the signal converter circuit 96 via the driving line VDD1 to normally drive the signal converter circuit 96. The voltage, to be supplied to the drive voltage signal generator circuit 97 from the drive pulse power source 95, is supplied to the drive voltage generator circuit 97 via the driving line VDD2, and also charges the electrolytic capacitor 109 provided midway. To jet the ink, current is supplied from the electrolytic capacitor 109 to the drive voltage generator circuit 97 via the driving line VDD2, and consequently, sufficient current is supplied to the actuator 11.

On the first cable 121, capacitors 80*a*, as the circuit elements 80 disposed near the driving IC chip 12*c*, are bypass-connected between the driving line VDD1 and the grounding line VSS1 and between the driving line VDD2 and the grounding line VSS2, and a resistor 80*b* is connected between the common potential line COM and the line VSS2.

Since each of the drivers 110 of the drive voltage signal generator circuit 97 has a plurality of transistors for actuator ON/OFF which are connected in series to an output line, transient current flows to the grounding line VSS2 at the moment of actuator ON. Without the capacitors 80*a*, relatively high voltage occurs in the VSS2 due to a resistance component and an inductance component of the flexible flat cable 12. At this time, since the resistor R having low resistance is connected between the lines VSS1 and VSS2, the increase in the voltage of the VSS2 results in an increase in voltage of the VSS1, which disturb a voltage relation relative to the control signals such as the data in the signal converter circuit 96 and therefore, the control signal is not normally recognized, which has sometimes caused a malfunction. On the other hand, with the capacitors 80*a* mounted near the driving IC chip 12*c*, since a charged-current charged during the actuator driving time is supplied from the capacitors 80*a*, the voltage increase (the voltage swell) of the VSS2 and VSS1 is suppressed to be small, which can prevent the malfunction in recognizing the control signal.

Meanwhile, when the piezoelectric material of the actuator 11 is heated and cooled during the polarization processing of the piezoelectric material in manufacturing processes, electric charges are generated. When these charges are short-circuited between the common potential line COM and the driving IC chip 12*c* or the control signal, large current flows and the driving IC chip 12*c* is sometimes broken. When a resistor 80*b* is mounted near the driving IC chip 12*c*, the aforesaid charges are discharged through the resistor 80*b*. Therefore, it is possible to prevent the breakage of the driving IC chip 12*c*.

Since the capacitors 80*a* and the resistor 80*b* are thus mounted on the flexible flat cable 12 at positions near the driving IC chip 12*c*, the effects as described above are exhibited. FIG. 5 shows a concrete state of this arrangement.

The driving lines VDD1 and VDD2, the ground lines VSS1 and VSS2, and the common potential line COM, which are in FIG. 6, are actually formed, on the first cable 121, symmetrically along both side edges parallel to the direction in which they are drawn from the actuator 11. Therefore, as shown in FIG. 5, the circuit elements 80 are also mounted at positions along the both side edges. Further, in FIG. 5, the circuit elements 80 are disposed at a portion, of the flexible portion 12*b*, on the actuator side of the driving IC chip 12*c* (the end portion side where the first terminal electrodes 89*a* are formed) or are also disposed at another portion, of the flexible portion 12*b*, extended in a width W direction of the driving IC chip 12*c*. It is possible to realize this arrangement by leading the aforesaid lines toward the actuator side of the driving IC chip 12*c* on the first cable 121.

The detailed structure of the first cable 121 on which these driving IC chip 12*c* and circuit elements 80 are mounted and manufacturing processes thereof will be explained.

Figure 7:
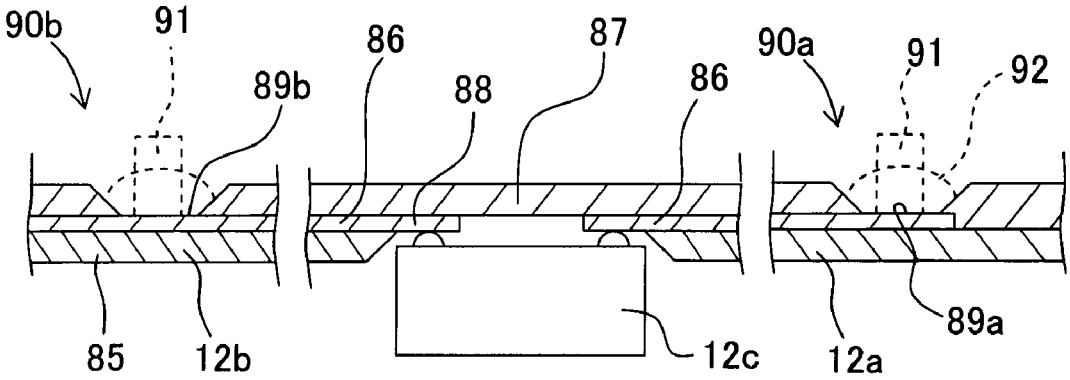
FIG. 7 is a cross-sectional view of the flexible flat cable.

As shown in FIG. 7, the first cable 121 includes: a belt-shaped base film 85 made of an insulative material (polyimide or the like); a large number of conductive wires 86 formed by etching a conductive material (copper foil or the like) bonded on one surface of the base film 85; and a cover film 87 made of an insulative material and covering the conductive wires 86. In the flat portion 12*a*, openings are formed in the cover film 87 at positions (joint portion 90*a*) corresponding to the outer individual electrodes 43 and the outer common electrode 44 of the actuator 11 respectively, and end portions of the conductive wires 86 are exposed from the openings, thereby forming the first terminal electrodes 89*a*.

In the flexible portion 12*b*, openings are formed in the cover film 87 at positions where the circuit elements 80 are to be mounted (mounting portion 90*b*), and middle portions of the conductive wires 86 are exposed from the openings, thereby forming second terminal electrodes 89*b*.

Figure 8A:
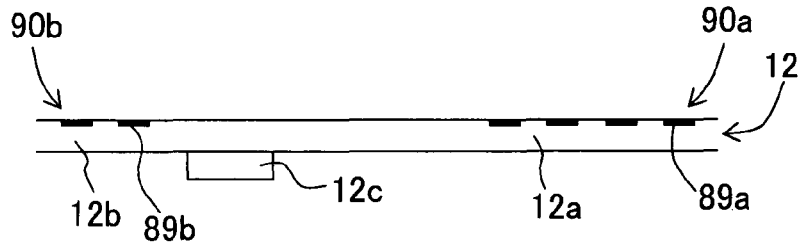
FIGS. 8A to 8F are views showing mounting processes on the flexible flat cable in manufacturing processes, FIG. 8A showing an electrode forming process, FIG. 8B showing an application process, FIG. 8C showing a setting process, FIG. 8D showing a softening process, FIG. 8E showing a bump forming process, and FIG. 8F showing a joining process.
Figure 8B:
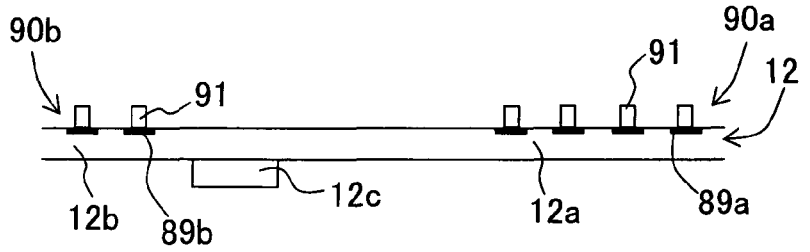

As shown in FIG. 8A, the openings are formed in one surface of the flexible flat cable 12, thereby forming the first and second terminal electrodes 89*a*, 89*b* exposed from these openings (electrode forming process). Next, as shown in FIG. 8B, conductive solder pastes 91 are applied on the terminal electrodes 89*a*, 89*b* by a printing method or the like (application process). At this time, since the openings are arranged in the same surface of the flexible flat cable 12, the solder pastes 91 can be simultaneously printed.

Figure 8C:
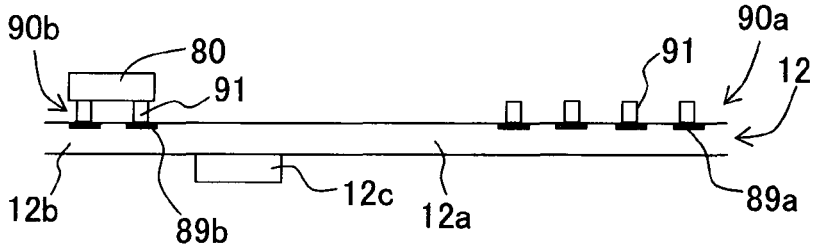
Figure 8D:
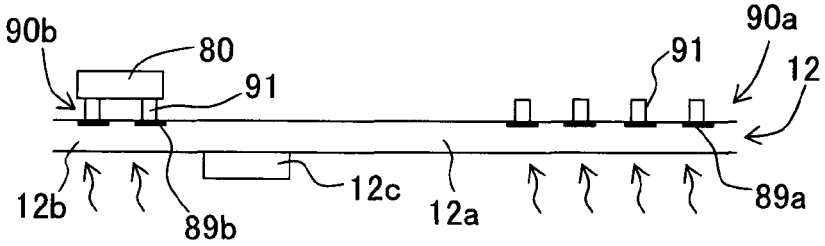
Figure 8E:
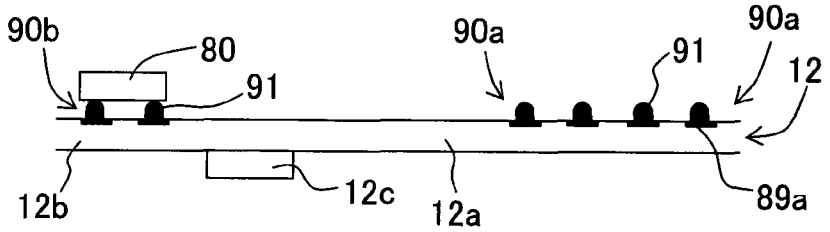

Next, as shown in FIG. 8C, the circuit elements 80 are mounted on the mounting portion 90*b* (setting process). Next, as shown in FIG. 8D, the solder pastes 91 on the joint portion 90*a* and the mounting portion 90*b* are softened by irradiating infrared, laser, or the like (reflow process, softening process), thereby forming bumps 92 on the first terminal electrodes 89*a* on the actuator 11 side and electrically joining the circuit elements 80 to the solder pastes 91 on the mounting portion 90*b* (bump forming process) as shown in FIG. 8E. Thereafter, the solder pastes 91 are once cooled to be cured, and consequently, the mounting of the circuit elements 80 is completed in the mounting portion 90*b*.

Figure 8F:
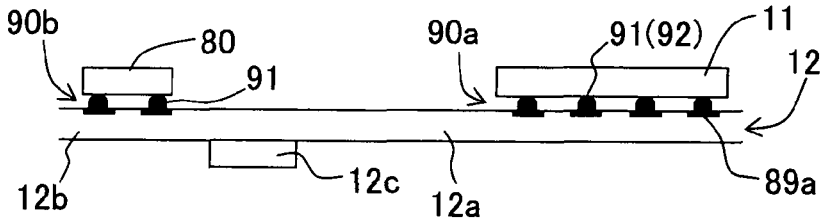

Next, as shown in FIG. 8F, the bumps 92 on the first terminal electrodes 89*a* on the actuator 11 side are made to face the outer individual electrodes 43 and the outer common electrode 44 of the actuator 11 respectively. Thereafter, while the bumps 92 are heated, the first cable 121 and the actuator 11 are pressed in a direction so as to approach each other. Consequently, the first cable 121 and the actuator 11 are electrically joined (joining process).

Incidentally, prior to the above-described processes, part of the conductive wires 86 are exposed to form third terminal electrodes 88 by forming an opening in the base film 85, and the driving IC chip 12*c* is mounted on the third terminal electrodes 88 by softening solder in the same manner as above.

As described above, in this embodiment, the circuit elements 80 disposed near the driving IC chip 12*c* are not mounted on the front surface, of the flexible flat cable 12, on which the driving IC chip 12*c* is mounted but are intentionally mounted on the opposite rear surface. That is, since the circuit elements 80 are formed on the same surface, of the flexible flat cable 12, facing the actuator 11, it is possible to mount the circuit elements 80 on the mounting portion 90*b* by utilizing the process of forming the bumps 92 on the joint portion 90*a* (first terminal electrodes 89*a*) joined to the actuator 11.

The process of forming the bumps 92 in order to electrically join the actuator 11 and the flexible flat cable 12 is a process indispensable for the manufacturing processes. Since the solder pastes used in mounting the circuit elements 80 are printed simultaneously when the solder pastes 91 for forming the bumps 92 are printed, the number of the manufacturing processes is not greatly increased, which enables efficient manufacture.

Further, in the present invention, since the circuit elements 80 are mounted on the rear surface of the flexible flat cable 12, there is no concern that the circuit elements 80 may hinder the driving IC chip 12*c* mounted on the front surface of the flexible flat cable 12 from being in close contact with the heat sink 60. Owing to no hindrance to the close contact between the driving IC chip 12*c* and the heat sink 60, an effect is exhibited that the heat of the driving IC chip 12*c* can be surely released by the heat sink 60.

Figure 9:
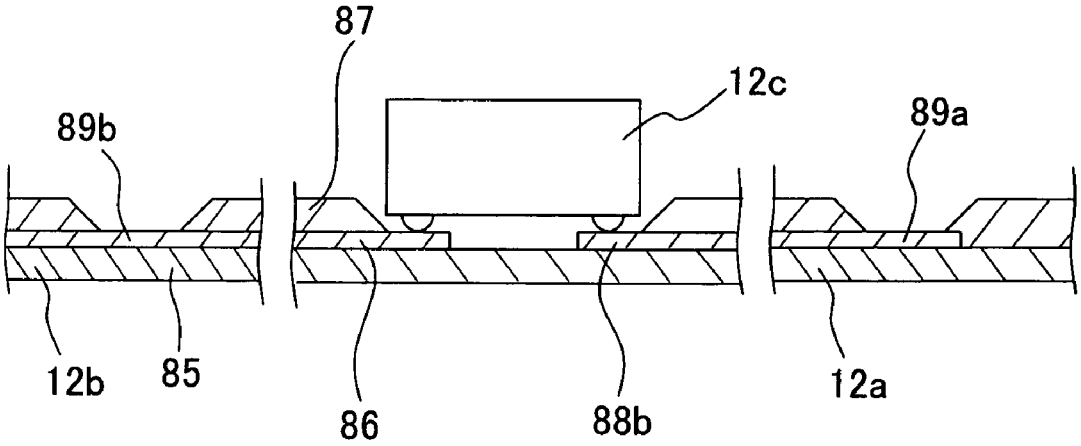
FIG. 9 is a cross-sectional view of a flexible flat cable of another embodiment.

FIG. 9 shows another embodiment. A surface, of the flexible flat cable 12, on which the driving IC chip 12*c* and the circuit elements 80 are mounted is the same as a surface joined to the actuator 11. Specifically, the first terminal electrodes 89*a* connected to the electrodes 43, 44 of the actuator 11, the second terminal electrodes 89*b* connected to the circuit elements 80, and the third terminal electrodes 88 connected to the driving IC chip 12 are formed on one surface side of the first cable 121, and these electrodes are exposed from openings of the cover film 87. To mount the driving IC chip 12*c* and the circuit elements 80, solder pastes are applied on these terminal electrodes, the driving IC chip 12*c* and the circuit elements 80 are set thereon, and the solder pastes are softened by heating. As in this embodiment, the driving IC chip 12*c* and the circuit elements 80 can be formed on the same surface of the flexible flat cable.

The above-described embodiment show, as an example, the flexible flat cable 12 is inserted through the slit 55 of the head holder 8 to be bent twice in a stepped form, but it should be noted that the flexible flat cable 12 is not limited to the example, and the present invention is applicable to any form in which the circuit elements 80 mounted on the flexible flat cable 12 are mounted.

The above-described embodiment explain the example where the present invention is applied to the ink-jet recording apparatus, but the present invention is applicable to any of recording apparatuses of various types such as an impact-type recording apparatus, that includes a plurality of recording elements and driving portions corresponding to the recording elements. In the above-described embodiment, the solder paste is used as the conductive material, but the present invention is not limited to this, and for example, any of other conductive materials such as silver paste is usable. Further, in the above-descried embodiment, the solder pastes are applied on the terminal electrodes of the flexible flat cable by printing, but the solder pastes may be applied by any other method, such as a method of applying the conductive material only on desired regions by using a mask material.

What is claimed is:

1. A method for manufacturing a recording apparatus which includes: a recording head including a plurality of recording elements and an actuator having a plurality of driving portions selectively driving the recording elements; a flexible flat cable having a plurality of conductive wires electrically connected to the driving portions of the actuator at one end of the conductive wires; and a circuit element mounted on the flexible flat cable, the method comprising:

forming a plurality of first terminal electrodes, which are to be connected to the driving portions, by exposing one ends of the conductive wires in one surface of the flexible flat cable, and a plurality of second terminal electrodes, which are to be connected to the circuit element, by exposing a part of each of the conductive wires in the one surface of the flexible flat cable;

applying a conductive material on the first terminal electrodes and the second terminal electrodes;

arranging the circuit element on the second terminal electrodes;

softening the conductive material by heating;

forming bumps on the first terminal electrodes by curing the softened conductive material while joining the circuit element to the second terminal electrodes by curing the softened conductive material; and joining the first terminal electrodes to the driving portions of the actuator by positioning the first terminal electrodes to the driving portions and by heating and softening the bumps.

2. The method for manufacturing the recording apparatus according to claim 1, wherein the conductive material is solder paste, the solder paste is applied on the first and second terminal electrodes by printing, and subsequently the circuit element is arranged on the second terminal electrodes.

3. The method for manufacturing the recording apparatus according to claim 1, wherein:

the flexible flat cable includes an insulating base film and a cover film which are disposed to sandwich the conductive wires;

the first and second terminal electrodes are exposed, upon forming the first and second terminal electrodes, by forming openings at portions, of the cover film, corresponding to the first and second terminal electrodes of the conductive wires; and the conductive material is applied, upon applying the conductive material, on the first and second terminal electrodes exposed from the openings formed in the cover film.

4. The method for manufacturing the recording apparatus according to claim 1, wherein the recording apparatus further includes: a driving IC chip mounted on the flexible flat cable to supply a drive voltage signal selectively to the driving portions of the actuator; and a power source;

and the method further comprising connecting the circuit element to the conductive wires between the driving IC chip and the power source to supply current to the driving IC chip and the driving portions.

5. The method for manufacturing the recording apparatus according to claim 4, further comprising:

forming a third terminal electrode, which is to be connected to the driving IC chip, by exposing a part of each of the conductive wires in a surface of the flexible flat cable opposite the one surface thereof; and joining the driving IC chip to the third terminal electrode.

6. The method for manufacturing the recording apparatus according to claim 4, further comprising:

forming a third terminal electrode, which is to be connected to the driving IC chip, by exposing a part of each of the conductive wires in the one surface of the flexible flat cable;

applying the conductive material on the third terminal electrode;

arranging the driving IC chip on the third terminal electrode; and joining the driving IC chip to the third terminal electrode by curing the softened conductive material.

7. The method for manufacturing the recording apparatus according to claim 1, wherein the actuator is a piezoelectric actuator, and the method further comprising:

performing polarization processing to the piezoelectric actuator by heating and subsequently cooling the piezoelectric actuator, wherein the circuit element discharges charges generated when the piezoelectric actuator is heated and cooled during the polarization processing.

8. The method for manufacturing the recording apparatus according to claim 1, wherein, the conductive material is heated by being irradiated an infrared light or a laser, upon softening the conductive material.

9. The method for manufacturing the recording apparatus according to claim 6, wherein the recording apparatus includes a heat sink, and the method further comprising contacting the driving IC chip joined to the third terminal electrode with the heat sink tightly.

10. The method for manufacturing the recording apparatus according to claim 1, wherein the circuit element includes a resistor and a capacitor.

11. The method for manufacturing the recording apparatus according to claim 4, wherein the flexible flat cable has a first flexible flat cable of which one end is connected to the driving portions of the actuator and a second flexible flat cable connected to the other end of the first flexible flat cable, and the driving portions, the circuit element, and the driving IC chip are connected to the first flexible flat cable.

* * * * *